US007775499B2

(12) United States Patent
Metcalf

(10) Patent No.: US 7,775,499 B2
(45) Date of Patent: Aug. 17, 2010

(54) FOUNDATION FOOTING FORM AND WALL FORM SUPPORT APPARATUS

(76) Inventor: Robert W. Metcalf, 24015 114$^{th}$ Ave., East, Graham, WA (US) 98338

( * ) Notice: Subject to any disclaimer, the term of this patent is extended or adjusted under 35 U.S.C. 154(b) by 1072 days.

(21) Appl. No.: 11/333,053

(22) Filed: Jan. 17, 2006

(65) Prior Publication Data

US 2006/0185293 A1 Aug. 24, 2006

Related U.S. Application Data

(60) Provisional application No. 60/644,623, filed on Jan. 18, 2005.

(51) Int. Cl.
*E04G 11/06* (2006.01)
*E04G 17/06* (2006.01)

(52) U.S. Cl. ..... 249/34; 249/216

(58) Field of Classification Search ..... 249/34, 249/207, 210, 213, 216
See application file for complete search history.

(56) References Cited

U.S. PATENT DOCUMENTS

| | | | | |
|---|---|---|---|---|
| 940,463 | A | 11/1909 | Kay | |
| 972,618 | A * | 10/1910 | Haag | 249/216 |
| 2,250,064 | A | 7/1941 | Jorsch | |
| 2,251,775 | A | 8/1941 | Arrighini | |
| 2,289,819 | A * | 7/1942 | Wirtane | 249/34 |
| 2,387,445 | A | 10/1945 | Herring | |
| 2,614,311 | A | 10/1952 | Shook | |
| 3,697,039 | A * | 10/1972 | Phelps et al. | 249/210 |
| 3,722,849 | A * | 3/1973 | Luyben | 249/34 |
| 4,783,935 | A | 11/1988 | Creager | |
| 5,207,931 | A * | 5/1993 | Porter | 249/210 |
| 5,511,761 | A | 4/1996 | Schultz | |
| 5,794,393 | A | 8/1998 | Fearn | |
| 5,799,399 | A | 9/1998 | Schultz | |
| 5,882,540 | A | 3/1999 | Farrington | |
| 6,158,710 | A | 12/2000 | Matthews | |
| 6,332,599 | B1 | 12/2001 | Spartz | |
| 6,568,141 | B2 | 5/2003 | Kremers | |
| 7,243,897 | B2 * | 7/2007 | Huber et al. | 249/34 |
| 7,255,319 | B2 * | 8/2007 | Albano | 249/34 |
| 2003/0101670 | A1 * | 6/2003 | Gustin | 249/34 |
| 2004/0007656 | A1 | 1/2004 | Seela | |

* cited by examiner

*Primary Examiner*—Michael Safavi
(74) *Attorney, Agent, or Firm*—Brian D. Metcalf; Kammer Browning PLLC

(57) ABSTRACT

An improved moldable material forming system, including but not limited to concrete foundation footing and wall forming system, comprising at least one pair of prefabricated support units or structures designed to hold in place forms, and rebar or other materials intended to be placed within the structure, during the monolithic pouring of the moldable material for the structure, including method of using such support units to allow monolithic pouring of the moldable material for the structure.

4 Claims, 9 Drawing Sheets

FOUNDATION FOOTING FORM AND WALL FORM SUPPORT APPARATUS

PRIORITY CLAIM

Applicant claims the benefit under Title 35 United States Code §119(e) of U.S Provisional Application No. 60/644,623 filed on Jan. 18, 2005.

BACKGROUND OF THE INVENTION

1. Technical Field

Embodiments of the invention include a simple quick technique and related structures to set up and support conventional foundation footing and wall forming materials for a monolithic pouring of cement or other materials, including, but not limited to plastics, polymers, metals and other moldable forming materials.

2. Background

The tremendous amount of activity relating to attempts to develop structures and systems for the monolithic pouring of foundation footing and wall systems for building construction or other purposes demonstrates the importance of, and the need for, a more simplified procedure for the monolithic pouring of cement or other building material such as plastics, polymers, metals or other moldable materials for foundation footing and wall systems and other molded structures. In spite of the numerous ideas and attempts to develop a more simplified form support structures and methods for the support of forms for the monolithic pouring of cement for foundation footing and wall combinations, or other molded structures, such efforts have either been judged to be too complicated or too expensive for normal use.

DETAILED DESCRIPTION

Figures 1, 2:
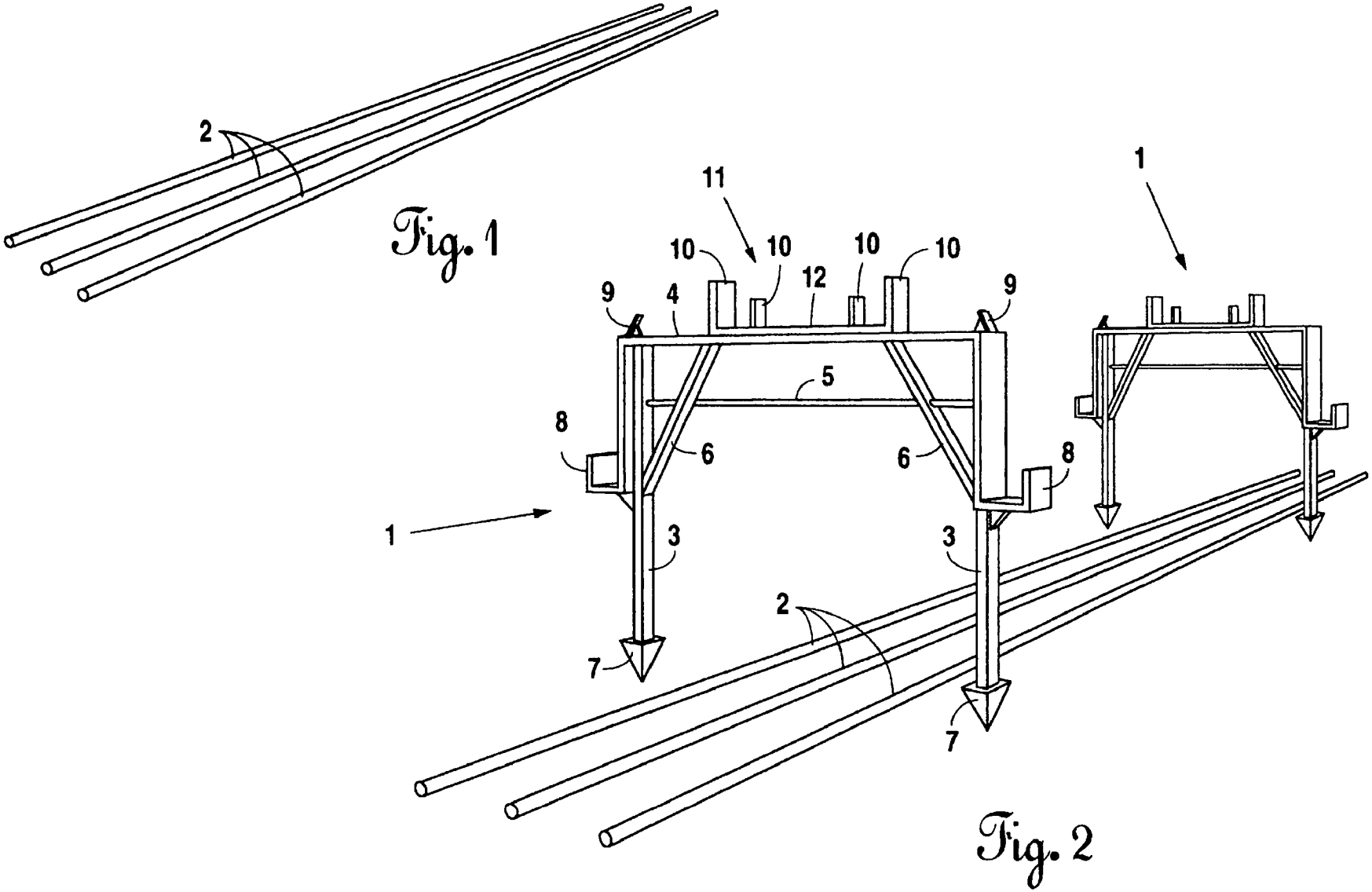
FIG. 1 is an illustration of some activities that may be used before or during setting up forms in various embodiments.
FIG. 2 illustrates the support units in various embodiments.

With reference to FIG. 1, the placement of rebar or other material to be enclosed in the final structure placed in the appropriate location is disclosed.

With reference to FIG. 2, two (2) support units (1) are disclosed placed over standard rebar (2), each support unit comprising two vertical members (3) spaced a distance apart equal to the desired width for the final concrete (or other forming material) foundation footing with a horizontal cross member (4) connected near the top, or at another convenient location, of each of the vertical members (3). One or more additional horizontal supporting cross member(s) (5) may be placed between, and attached to, the vertical members (3) at appropriate locations along the vertical members for required support or for ease of rebar placement or for other purposes. Further support can be provided by additional support members (6) placed at an angle between the vertical members(3) and the horizontal member(s) (4) and/or (5). The bottom of the vertical members (7) can be designed so as to be pressed and/or hammered into the ground, though other variations are possible as explained below. L-shaped members (8) are placed on the outside of the vertical members at the location intended for the bottom of the concrete (or other forming material) foundation footing, for form placement, and a hook or other connector (9) is placed near the edge of the top of each vertical member (3), or other convenient location, for future placement and attachment of a top clip to hold the concrete (or other forming material) foundation footing forming board in place. Protruding from the top of the top horizontal member (4) are four additional vertical members (10) placed appropriately for proper placement and support of the concrete (or other forming material) foundation wall forms so as to provide support and stability for the bottom of optional foundation wall forms. Alternatively a top cleat (11) comprised of a horizontal member (12) with four vertical members (10) appropriately spaced can be attached to the top horizontal member (4) of the support structure. The embodiments also include L-shaped top clips identified in FIG. 6 that are properly sized and formed to be fitted so as to support the top of the concrete (or other forming material) foundation footing forms and are intended to be attached to the hook (9) on the top of each vertical member (3) to stabilize the top of the foundation footing forms. The embodiments also includes optional methods for adjustment of the length of the members and the angles of member intersections to allow adjustments to conform with the requirements of the design.

Figure 3:
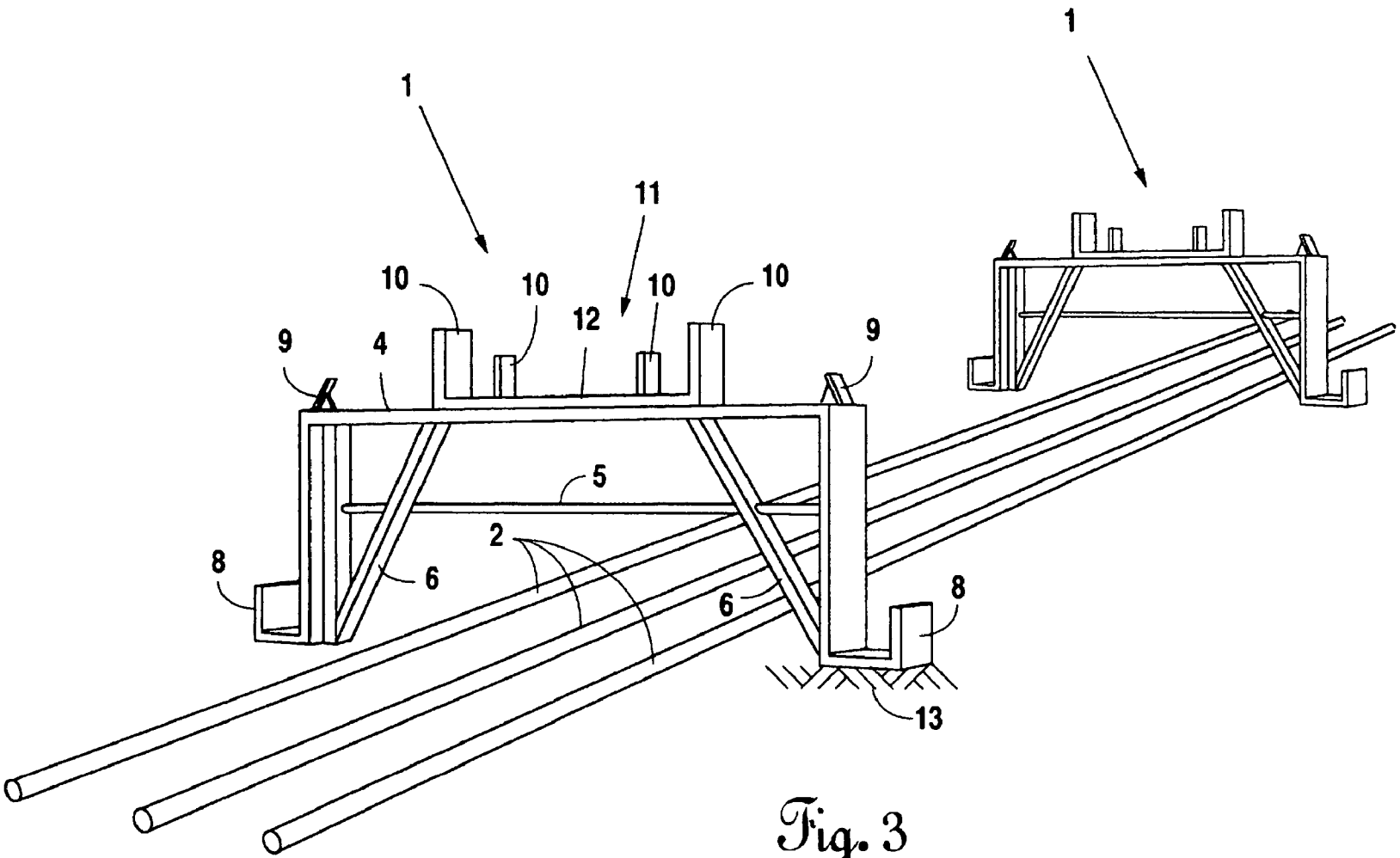
FIG. 3 illustrates stabilized support units.

With reference to FIG. 3, one method is disclosed for stabilization of the support units where same are pressed or hammered into the ground (13) over the location for the concrete (or other forming material) pour for the foundation footing. Numerous other methods are available for stabilization of the support units.

Figure 4:
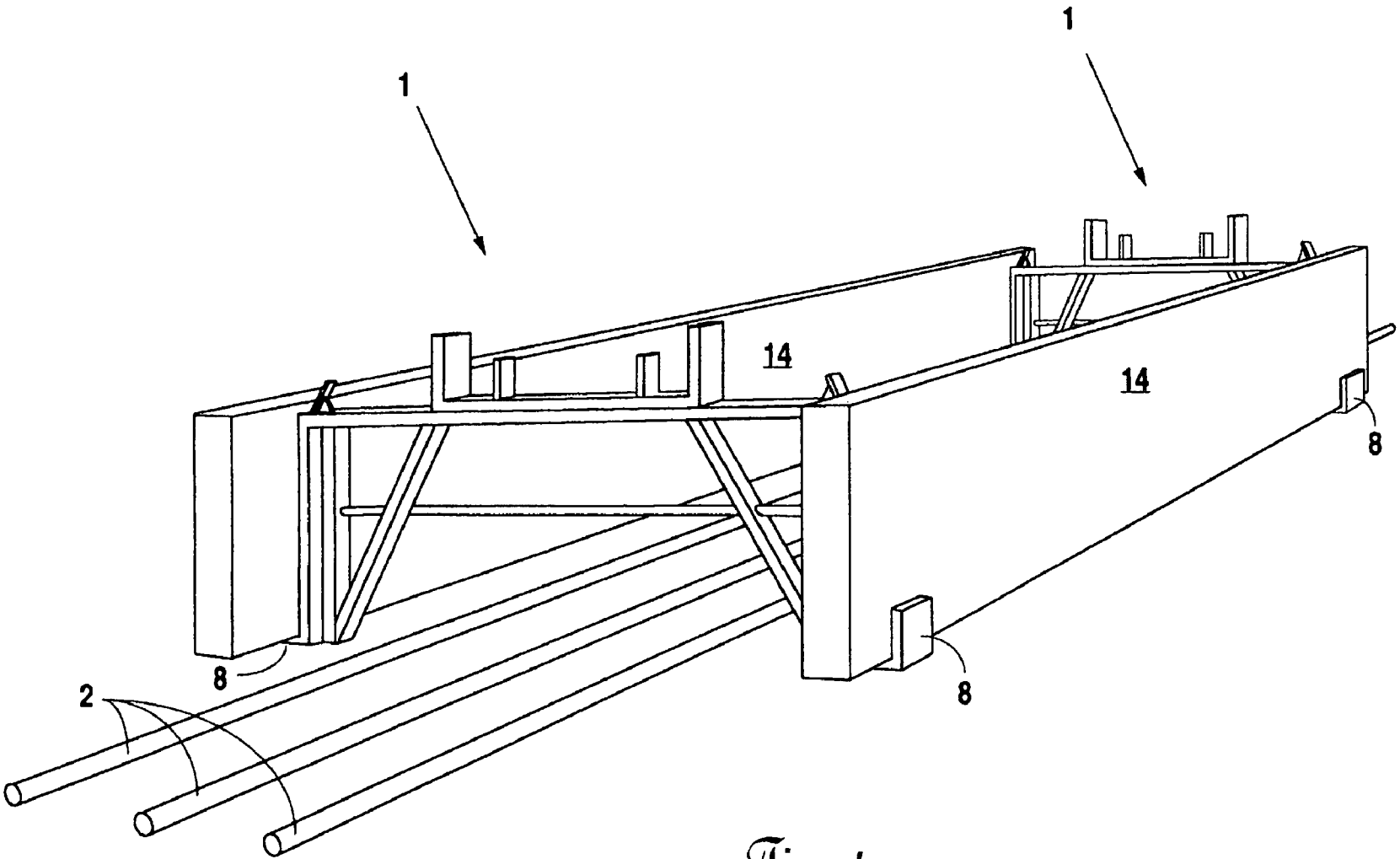
FIG. 4 illustrates embodiments for placement of forms.

With reference to FIG. 4, a method is disclosed for placement of the lower form (14) onto the main support units over the L-shaped members (8) placed on the outside of the vertical members (3), which lower form will control the placement of the concrete (or other forming material) pour for the foundation footing.

Figure 5:
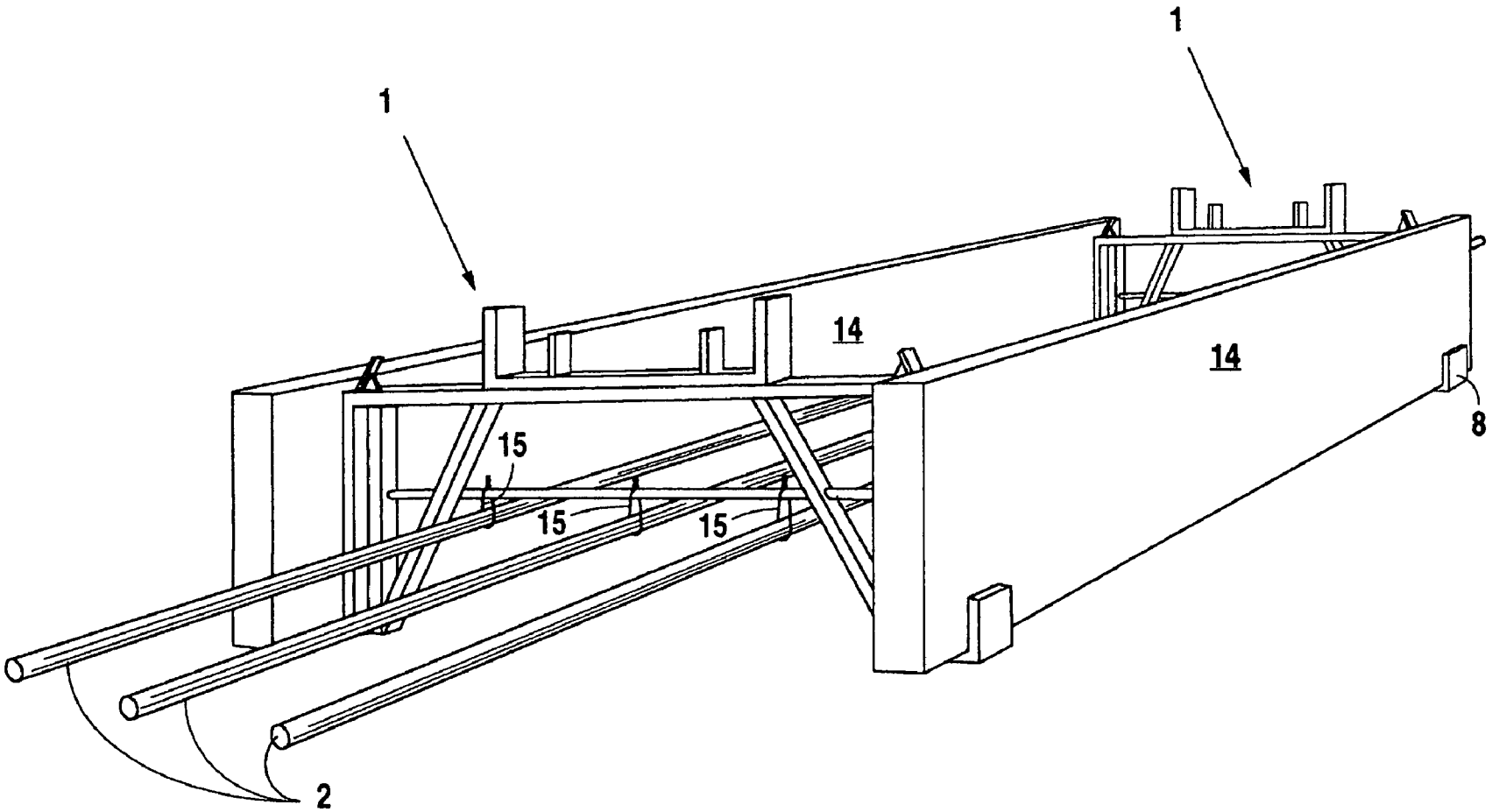
FIG. 5 illustrates embodiments for rebar stabilization.

With reference to FIG. 5, a method is disclosed for placement of rebar (2) by tying same onto one of the horizontal members (5) of the support structure using a type of hanging material (15) so that the rebar will be incorporated into the cement or other moldable materials for the foundation footing, if needed. Alternatively, the rebar could be placed on the top of a horizontal member (5) and tied directly to same to stabilize the rebar during the pour.

Figure 6:
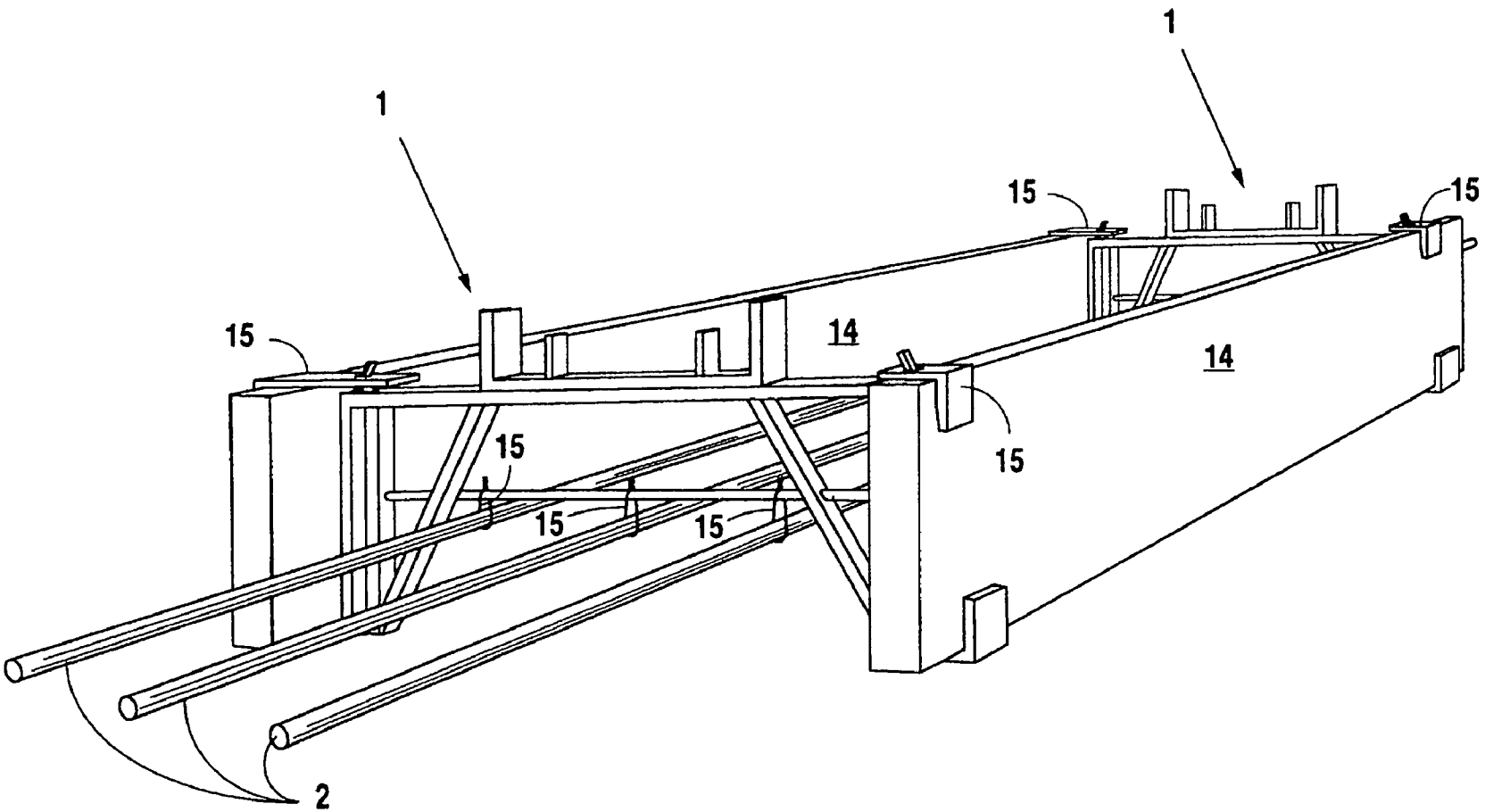
FIG. 6 illustrates embodiments to stabilize the forms.

With reference to FIG. 6, a method is disclosed for holding the lower foundation footing forms (14) firmly in place through placement of the L-shaped clips (15) onto the main support structures over the hook or other connecting mechanism (9) placed near the edge of the top of each vertical member (3) that will firmly hold the top of the lower foundation footing forms (14) in place during the concrete (or other forming material) pour.

Figure 7:
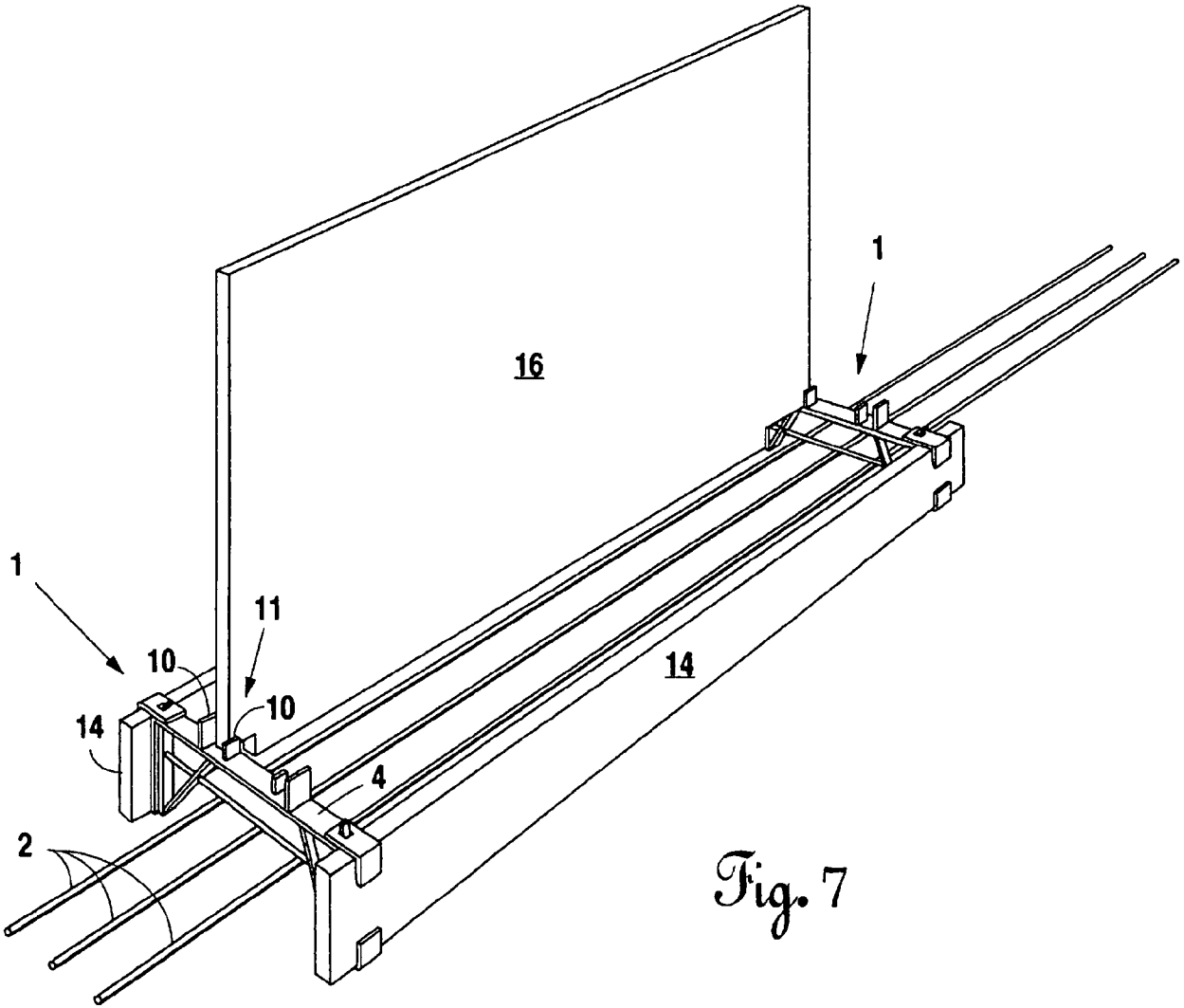
FIG. 7 illustrates embodiments for placement of the side panel form.

With reference to FIG. 7, a method is disclosed for placement of the first foundation wall form (16) into two of the top vertical members (10) protruding from the top of the top horizontal member (4) of the support structure intended for proper placement and support of the concrete (or other forming material) foundation wall forms (16) over the foundation footing section that will control and form the concrete (or other forming material) pour for the foundation walls.

Figure 8:
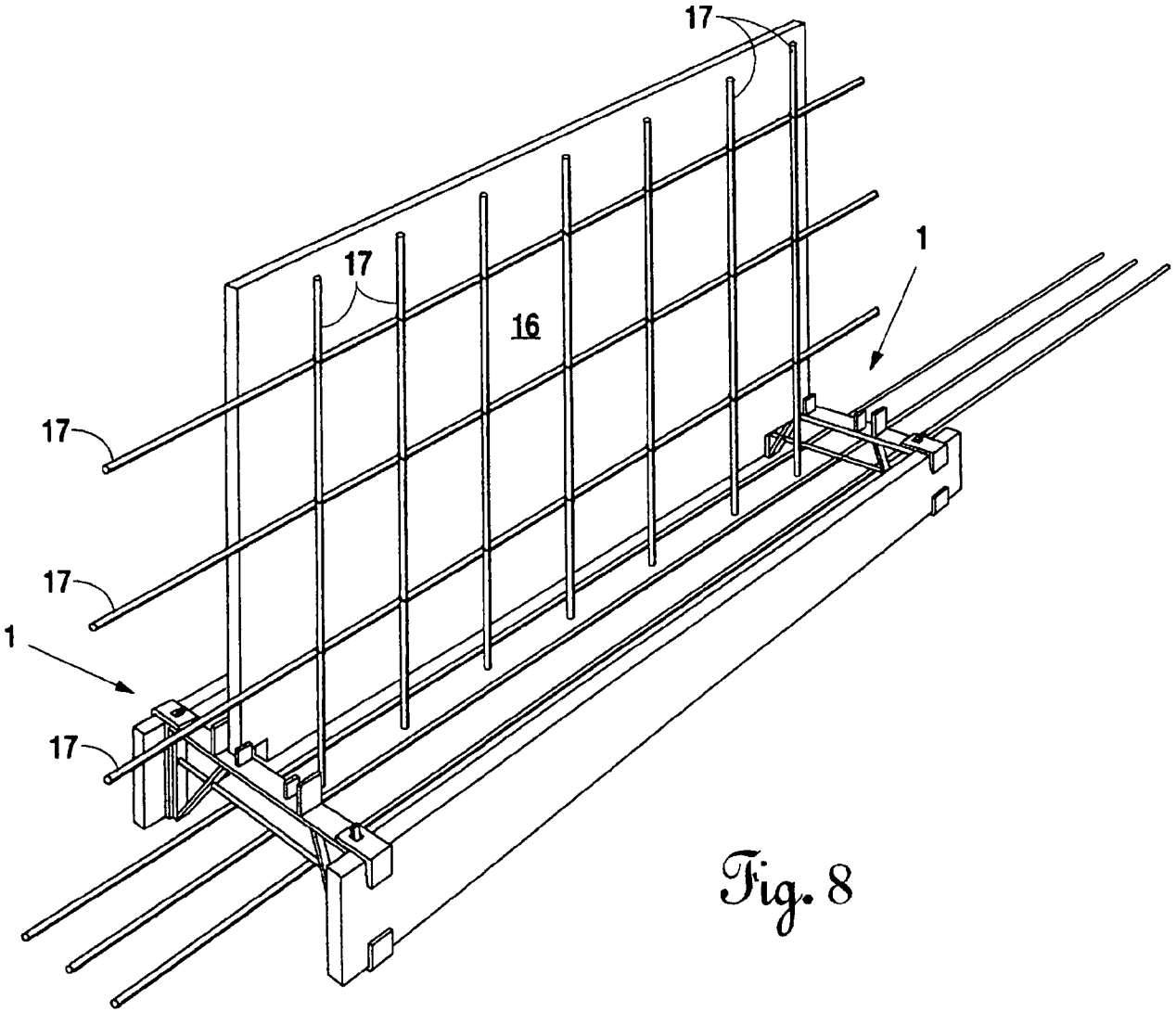
FIG. 8 illustrates embodiments for wall rebar or other materials placement.

With reference to FIG. 8, a method is disclosed for placement of rebar for the foundation wall (17) or other materials on the inside of the first foundation wall form (16) so that the rebar for the wall (17) or other materials will remain internally in the foundation wall and within or over the foundation footing prior to the pour for added foundation wall strength or support as required.

Figure 9:
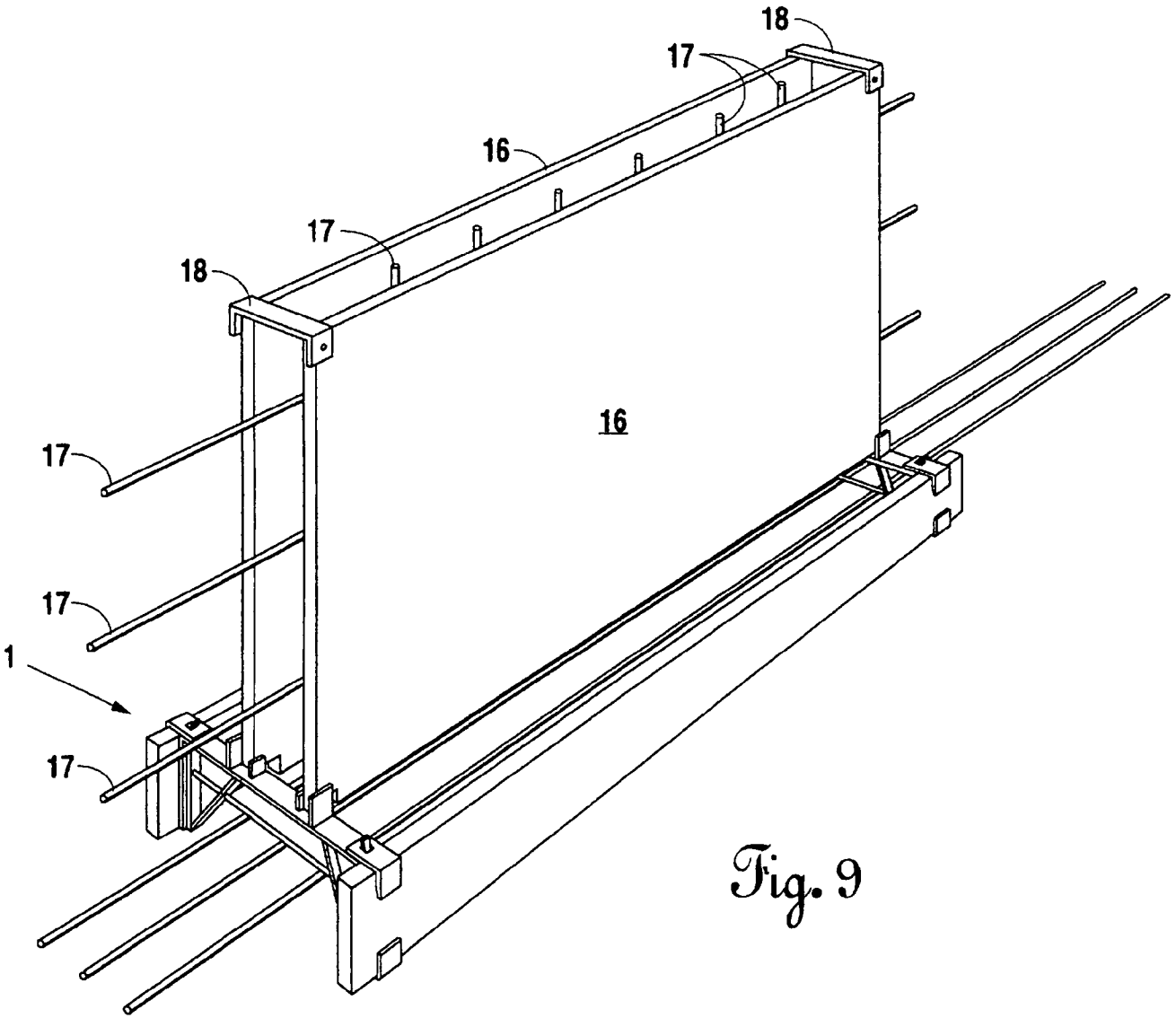
FIG. 9 illustrates embodiments for placement and stabilization of side panel forms.

With reference to FIG. 9, a method is disclosed for placement of the second foundation wall form (16) into the remaining two top vertical members (10) protruding from the top of the top horizontal member (4) of the support units that will enclose the optional rebar for the wall (17) or other materials required for strength and support within the concrete (or other forming material) foundation wall forms (16) over the foundation footing section that will control and form the concrete (or other forming material) pour for the foundation walls. FIG. 9 also discloses one method to support and stabilize the top of the foundation wall forms (16) through placement of top cleats (18) designed to hold the upper foundation wall forms (16) firmly in place during the monolithic cement pour for the foundation footing and wall.

Figure 10:
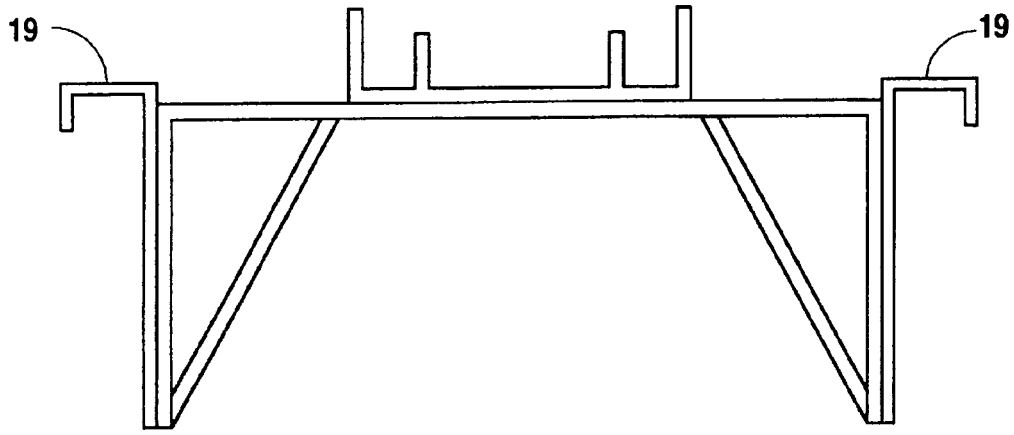
FIGS. 10 and 11 illustrate various embodiments of the support units.

With reference to FIG. 10, a variation to the form support structure is disclosed that would allow the form support structure to be hung, using upper L-shaped supports (19) incorporated into the form support structure, over the foundation footing forms conventionally stabilized. This method obviates the need to stake the form support structure directly into the ground or otherwise stabilize same.

Figure 11:
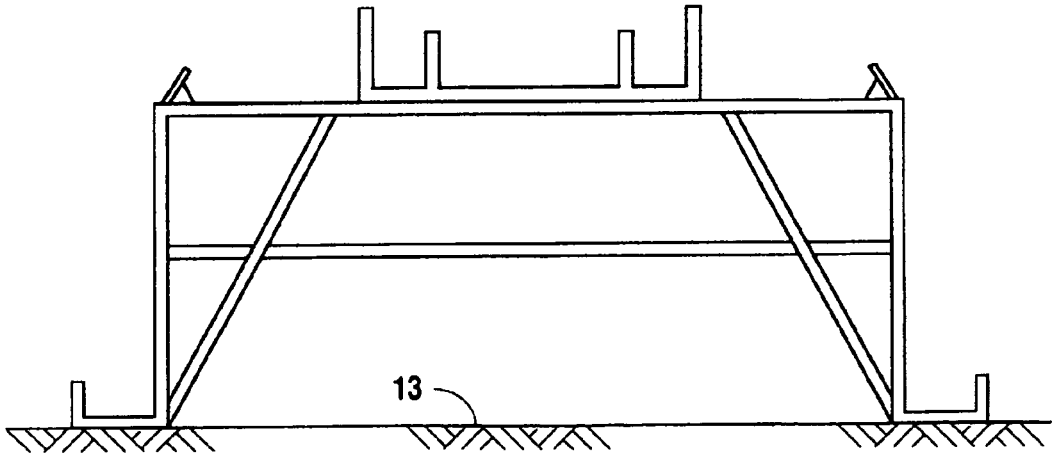

With reference to FIG. 11, a variation to the form support structure is disclosed that would allow the form support structure to be placed directly on the ground (13) to be supported and stabilized by conventional means.

Various embodiments could be manufactured in various sizes and dimensions dictated by varying codes and building requirements for foundation footings and walls and/or other structures, or alternatively the product could be manufactured with members that would allow same to be adjusted for length and angles to provide a method for in field adjustments to conform with the requirements of the design. Some embodiments have an optional lower bar as indicated which provides for lateral restraint and also supports the footing rebar or other materials to be enclosed in the structure. Embodiments allow for quick setup and take-down using conventional wood forming or other types of materials. Typically, but without limitation, these materials could be 2×8 wood foundation footing forms and 1⅛ inch plywood foundation wall forms, though other sizes could be used with only slight changes in the manufacturing process of the support system or through allowing optional adjustable members . There are several variations which are presented here which would allow for some flexibility of application. In addition, other variations may be used as dictated by field conditions and engineering requirements.

The forming units may be left cast in place. However, the forming materials and panels can be quickly and easily removed and reused. Generally, the spacing requirements for the forming units would be approximately 2 feet over center; however, conditions (i.e., foundation footing and wall widths and heights) could require closer, and might allow farther, spacing. The embodiments and techniques may save considerable labor expense for the foundation footing and wall contractor or others and constitutes a simple and quick way to set up concrete (or other forming material) forms, complete the pour, and take down forms, thus allowing the concrete contractor or others involved in form structures to do more work with less time and expense.

The accompanying drawings that form a part hereof show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived there from, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

The invention claimed is:

1. A monolithic foundation footing and wall form support system for pouring monolithically formed concrete material structures, said system comprising:

a. a forming unit which includes at least one pair of form support segments laterally positioned and arranged to face each other, appropriately spaced for pouring concrete or other forming materials, b. each said form support segment includes at least two laterally spaced vertical members appropriately placed to control the size of the pour of the concrete or other forming materials, c. each said form support segment includes at least one horizontal support and spacing member connecting the laterally spaced vertical members, d. each said form support segment includes an outside structure for placement and support of the bottom of foundation footing forms such as L-shaped members attached to the outside of said laterally spaced vertical members at the location intended for the bottom of the concrete foundation footing, e. each said form support segment comprises a structure for placement and support of the top portion of foundation footing forms such as a hook placed near the edge of the top of each laterally spaced vertical member for attachment of a top clip to hold the foundation footing forming board in place, f. each said form support segment includes support or bracing means for maintaining each form support segment in a rigid, generally right angle, relationship with the base or ground and parallel relationship with the corresponding forming unit, g. each said form support segment includes four vertical members protruding from the top of the at least one horizontal support and spacing member appropriately spaced for proper placement and support of the foundation wall forms or a top cleat comprised of a horizontal member with four vertical members appropriately spaced attached to the at least one horizontal support and spacing member so as to provide support and stability for the bottom of the foundation wall forms, and h. each said form support segment further includes a structure to support and stabilize the top of the foundation wall forms such as placement of top cleats obtained from normal commercial sources or other structures, designed to hold the upper foundation wall forms firmly in place during the monolithic cement pour for the foundation footing and wall.

2. The wall form support system of claim 1 wherein said laterally spaced vertical members are formed to allow hammering or pressing of said laterally spaced vertical members into the base or ground to stabilize.

3. The wall form support system of claim 1 wherein the bottom of said laterally spaced vertical members of said form support segments are formed with a base to allow direct placement onto the base or ground to be conventionally stabilized.

4. The wall form support system of claim 1 wherein the footing and wall form support system includes a structure for attachment of rebar that can then be held in place during the pour to provide added strength to the concrete (or other forming material) as necessary.

* * * * *